US011365112B2

(12) United States Patent
Nini

(10) Patent No.: US 11,365,112 B2
(45) Date of Patent: Jun. 21, 2022

(54) DELIVERING TAP WITH INTERNAL VALVE WITH FLEXIBLE EDGES AND MULTIPLE SEALS

(71) Applicant: VITOP MOULDING S.R.L., Alessandria (IT)

(72) Inventor: Diego Nini, Alessandria (IT)

(73) Assignee: VITOP MOULDING S.R.L., Alessandria (IT)

( * ) Notice: Subject to any disclaimer, the term of this patent is extended or adjusted under 35 U.S.C. 154(b) by 0 days.

(21) Appl. No.: 17/275,155

(22) PCT Filed: Jul. 25, 2019

(86) PCT No.: PCT/IT2019/000057
§ 371 (c)(1),
(2) Date: Mar. 10, 2021

(87) PCT Pub. No.: WO2020/053904
PCT Pub. Date: Mar. 19, 2020

(65) Prior Publication Data

US 2022/0041426 A1 Feb. 10, 2022

(30) Foreign Application Priority Data

Sep. 14, 2018 (IT) ..... 102018000008601

(51) Int. Cl.
*B67D 3/04* (2006.01)
*B65D 47/26* (2006.01)

(52) U.S. Cl.
CPC ..... *B67D 3/043* (2013.01); *B65D 47/26* (2013.01); *B67D 3/045* (2013.01)

(58) Field of Classification Search
CPC ..... B67D 3/043; B67D 3/045; B65D 47/26
See application file for complete search history.

(56) References Cited

U.S. PATENT DOCUMENTS 2,769,582 A * 11/1956 Schlicksupp ..... B65D 47/242 222/513
2,851,202 A * 9/1958 Bradbury ..... B65D 47/283 222/505
3,062,496 A * 11/1962 Stehlin ..... F16K 3/28 251/218
4,619,377 A * 10/1986 Roos ..... B67B 7/26 222/129
5,004,127 A * 4/1991 Morel ..... B05B 11/0027 222/521

(Continued)

*Primary Examiner* — Frederick C Nicolas
(74) *Attorney, Agent, or Firm* — Maschoff Brennan

(57) ABSTRACT

A delivering tap is described, for delivering liquids from a container including a main body with a connecting element that includes a fitting component for fitting with the container, and a supporting body adapted to be closed by a plug including an upper plug, an internal sealing valve and a stem, the supporting body including an outlet opening, an internal sealing surface and an external guiding component; the upper plug including the internal guiding component, a first fastening component and an upper sealing component; the stem including a second fastening component to the first fastening component of the upper plug, a stem sealing component, and the lower sealing component; the internal valve including a second valve sealing component and the first valve sealing component.

10 Claims, 18 Drawing Sheets

(56) References Cited

U.S. PATENT DOCUMENTS

| | | | | |
|---|---|---|---|---|
| 6,978,981 | B2 * | 12/2005 | Roos | B67D 3/045 251/265 |
| 7,721,755 | B2 * | 5/2010 | Smith | B65D 77/067 137/384 |
| 8,387,837 | B2 * | 3/2013 | Bellmore | B67D 3/043 222/571 |
| 8,640,931 | B2 * | 2/2014 | O'Keefe, Jr. | B67D 1/0004 222/505 |
| 10,696,536 | B2 * | 6/2020 | Nini | B67D 3/045 |
| 2006/0261099 | A1 * | 11/2006 | Nini | B67D 3/047 222/519 |
| 2012/0074343 | A1 * | 3/2012 | Meintjes | F16K 3/24 251/318 |
| 2018/0056259 | A1 * | 3/2018 | Roberts | B01F 3/04794 |

* cited by examiner

DELIVERING TAP WITH INTERNAL VALVE WITH FLEXIBLE EDGES AND MULTIPLE SEALS

The present invention refers to a delivering tap of liquids from containers, in particular and preferably the so-called containers of the "bag-in-box" (herein below called BIB) type. In particular, the invention can be considered an innovation of the one disclosed in International Patent Application WO2006030465, assigned to this Applicant, which can be considered the first solution, and is related to a delivering tap completely made of plastic material, suitable for all connecting systems existing on the market.

Moreover, the tap of the invention is also an improvement with respect to the one disclosed in International Patent Application PCT/IT2018/000004 filed on Dec. 1, 2018 by the same Applicant, since it simplifies production and assembly (simplifying both the geometry of pieces and their assembling, but obtaining a product which is wholly similar, but safer) though keeping and increasing the final features and advantages towards competitors of this product.

Object of the present invention is creating a delivering plug which allow delivering high amounts of liquid in a short time, and which allows having a delivering device with a front system which points out its opening with a "tamper evident" feature, which helps the end customer to recognize whether the plug has already been used, and integrated "counterfeit-preventing" systems on the back of the main body, which thereby does not allow removing the inventive tap from the container on which it is placed, once inserted in its final closure/use position, not allowing many following filling of a counterfeited product.

Another major feature is that the inventive tap must be produced completely with plastic material (therefore, easily recyclable) and with geometries which are simple to produce through a traditional injection molding, in order to lower its production costs.

Feature of the present invention is designing every single component which will be part of the inventive tap so that the lowest possible amounts of plastic material are used, and therefore underlining the aspect dealing with environmental safeguard, in addition to the better and cheaper production thereof due to the creation of "recesses" of material around the various geometries of the components.

Another object of the present invention is producing a tap which can be adapted to connecting systems existing on the market (shown herein below in FIGS. 12, 13 and 14).

Another important feature of the inventive tap is creating a tap equipped with a closing and opening system guided by a cam profile externally obtained on the main body and equipped with an internal valve which allows obtaining, due to its shape and once having completely assembled the inventive tap, a system with multiple internal seals, among the various components forming the inventive tap, which are mutually interconnected in certain positions.

A feature of the inventive tap is obtaining, due to the connection of the various formed parts, a tap, in particular an upper plug 2, an internal valve 5 and a stem 4 on a main body 3, where the two main front seals are called upper front seal (FUT herein below and in the figures) and lower front seal (FLT herein below and in the figures) shown in FIGS. 3, 7 and 18.

Another feature is obtaining an inventive tap with a main body geometrically shaped in order to obtain a rear seal (RT herein below and in the figures) shown in FIG. 18, when it is coupled with the neck of the container and/or preferably with the mouth of the BIB, not shown.

Another object is minimizing the amount of aria entering into the "Bag in Box" after its filling, optimizing the distribution of the components which will fill to a maximum the internal plug spaces, not allowing thereby the oxygen to occupy the majority of the internal volume of the inventive tap, and thereby also minimizing the oxidation of the product contained inside the bag, in case of BIB.

A feature is having an inventive tap equipped on its rear part with a removal-preventing system, preferably with a sharped edge, illustrated in FIG. 8, which shows the tap coupled with the internal geometry of the mouth, not shown in this document, in order to guarantee the end customer that it will be impossible to remove the inventive tap, once inserted in its final position, unless one destroys the system: it therefore operates also as counterfeit-preventing device to prevent performing a subsequent filling.

A feature of the inventive tap is shaping some components, especially the stem, so that a system can be created for "cutting the flow of delivered liquid", which avoids the fastidious formation of the final drop, which usually, at the end of the delivery, falls on the floor, fouling it. Known taps have systems for keeping the final drop which have operating problems.

A feature of the present invention is creating a tap which is completely made of plastic material (therefore, easily recyclable) and which is adapted to connectors present on the market, actually replacing the known tap versions, for example currently marketed by companies Illinois Tool Works (ITW), shown in FIG. 16 (10), and SCHOLLE IPN, shown in FIG. 15 (9).

Object of the present invention is creating a tap which is easy to manufacture and assemble, completely made of plastic material, which is adapted to connectors present on the market and with an integrated counterfeit-preventing (tamper evident) system, adapted to replace known tap versions.

The tap of the invention has an internal element which allows opening and closing the tap composed of three different components (upper plug, internal valve and stem) which, once assembled, mutually mechanically cooperate with a level of interferences among the components, creating a single element composed of three pieces, which, upon need, can be manufactured with three different materials (with different flexibility and/or rigidity), which help the manufactured meet all market needs: in fact, for example, the containers on which the delivering tap is placed, can contain aggressive chemical agents and require the use of special plastics with different flexibility/rigidity, cannot be used/obtained if the element which generates the opening and closing of the tap is formed of a single component, like the SCHOLLE IPN tap shown in FIG. 15.

The inventive tap has a shape of its main body such to enable and increase the final outlet flow of liquid due to a chute of FIG. 8, which gives prevalence to the flow along the direction of the outlet hole, as will be described below.

The inventive tap which allows obtaining the above mentioned features comprises four components, preferably all made of plastic material, obtained from injection molding: main body, upper plug, internal valve, stem, easy to manufacture and also easy to assemble, decreasing production costs and times.

After having described the single parts with their features, the innovative closing plug of FIG. 17 will be described.

Various tap configurations are known in the art, manufactured by company ITW Illinois Tool Works Inc. (herein below ITW), and by company SCHOLLE IPN (herein below SCHOLLE), which are known embodiments of this product, for example disclosed in documents AU656111 and WO2011008829.

Such known taps, however, have some defects and/or deficiencies. For example, the version produced by SCHOLLE IPN, shown in FIG. 15, is not equipped with a counterfeit-preventing tamper evident system (warranty seal), making thereby necessary to add an aluminum operculum on the liquid outlet hole, welding it to the main body to guarantee the tap integrity and the protection of the product contained in the BIB, and above all to provide a visual evidence of the performed first opening. Instead, the version produced by company ITW has a sort of tongue on the upper part, shown in FIG. 16, which is deformed upon the first opening, which should operate as warranty seal, providing evidence to the end consumer of the occurred first opening; this tongue can be located with difficulty, and therefore the evidence of opening the device is not immediate: therefore, it could also need an additional operculum, to provide more evidence of a first opening, thereby increasing the price of the final device, since it is necessary to add the operculum and the machine to weld it, making the plug less "eco-friendly", since there are two different materials to dispose of, plastics and aluminum.

There are no counterfeit-preventing/removal-preventing elements between tap and mouth, so that, in known taps, it is not possible to easily remove the plug from its seat to be able to fill the container with counterfeited liquid.

All prior art taps present on the market use opening systems through torsion (not with an automatic closure) of the plug which follows a cam profile; such profile is usually obtained on the main body of the tap, while the small teeth which are guided during the opening step are obtained on the plug, inside it, thereby complicating the die and the plastic piece (which, as described below, needs, when assembling, an additional piece of plastic to be able to cover the holes necessary to obtain inside the plug the two small teeth, which are guided by the cam profile present on the body).

In currently manufactured taps, there are systems for keeping the drop (after the delivery) which are scarcely efficient and highly increase the complexity of the die, in addition to refrain from solving the problem caused by the drop present after the delivery, at the end of the step of closing the tap, which can fall on the ground, creating discomfort for the end user.

Known taps allow a maximum flow of liquid which has reached a limit which cannot be exceeded with the prior art, which can instead be exceeded, due to structural geometric arrangements, by the tap of the invention.

In the known tap versions with cam opening (through unscrewing) placed with the front delivery chamber in a vertical position, there are always an upper seal on the plug and a lower seal on the liquid outlet hole. In the prior art, sometimes the upper seal is not perfect, as well as the lower seal.

In the tap of the invention, upon inserting into the system a component with flexible edges and with multiple seal, a perfect upper seal (FUT) is always obtained, also due to the chance of having different materials which compose the plug, comprising three components which can be obtained from different materials, not necessarily all rigid or semi-rigid, as prior art taps required, usually produced in a single piece, but also elastic, soft, flexible materials capable of guaranteeing an optimum seal. As regards the lower seal (FLT), it is performed due to special geometries, which improve the technologies of known taps, and also due to the change of producing the single component which determines the lower seal with a plastic material which is optimum for such purpose.

For example, should the tap has to deliver aggressive liquids, it becomes necessary to use a plastic material resisting to this liquid to make the component for the lower seal.

The tap of the invention allows using a specific material for each one of the three previously mentioned components, for their specific required use.

The tap of the invention, due to the division of the plug into three components, further allows simplifying both the geometry of the pieces of plastics composing the tap itself, and their assembling cycle, thereby drastically decreasing its final cost.

The above and other objects and advantages of the invention, as will result from the following description, are obtained with a delivering tap as claimed in claim 1. Preferred embodiments and non-trivial variations of the present invention are the subject matter of the dependent claims.

It is intended that all enclosed claims are an integral part of the present description.

It will be immediately obvious that numerous variations and modifications (for example related to shape, sizes, arrangements and parts with equivalent functionality) can be made to what is described, without departing from the scope of the invention, as contained in the enclosed claims.

The present invention will be better described by some preferred embodiments thereof, provided as a non-limiting example, with reference to the enclosed drawings, in which.

Figure 1:
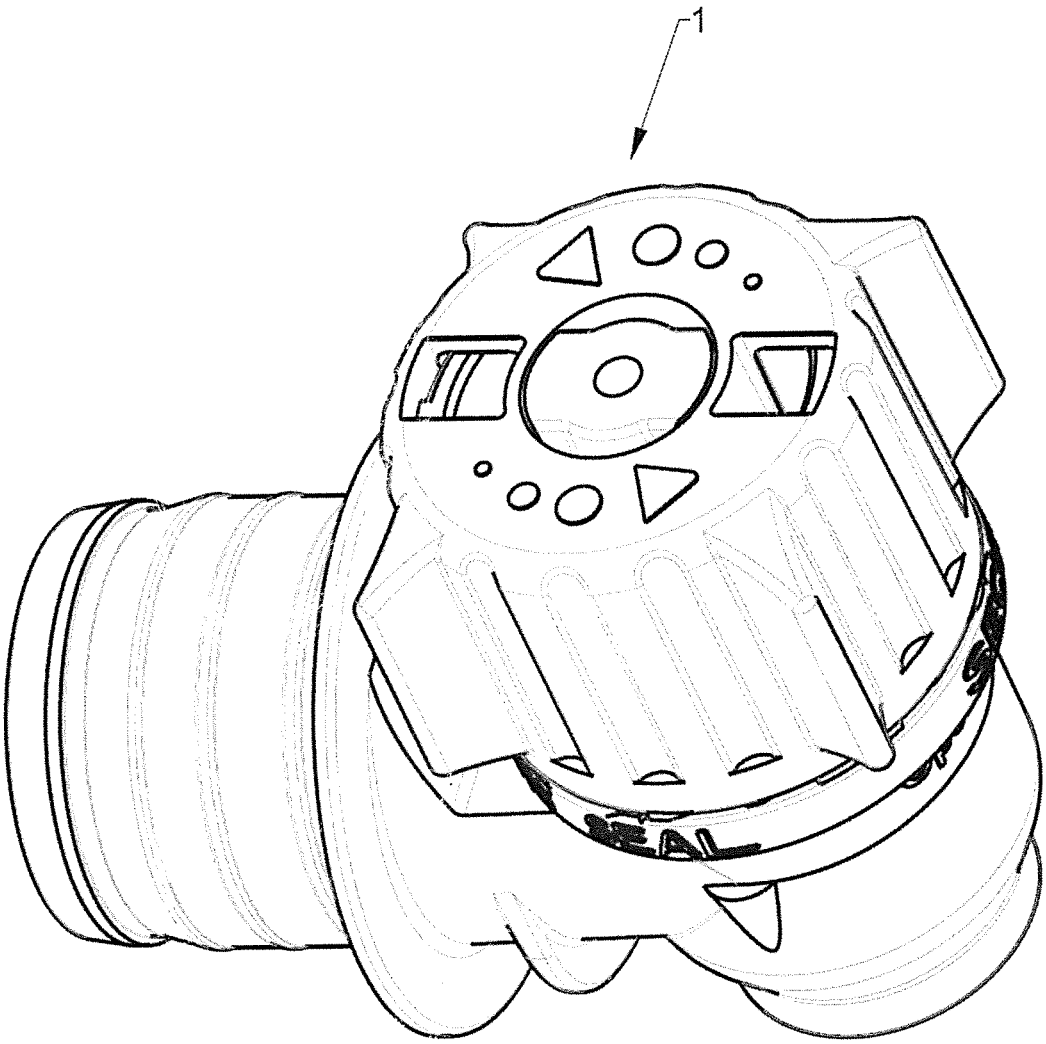
FIG. 1 is a perspective view of an embodiment of the tap according to the present invention.

With reference to the Figures, an example, non-limiting embodiment of the delivering tap 1 of the present invention is shown and described. It will be clear to a skilled person in the art that the described tap 1 can be made with equivalent shapes, sizes and part, and can be used for various types of containers, for example the so-called "Bag-in-Box", but also those of the rigid or semi-rigid type or others.

The tap 1 of the invention is used for delivering liquids from a container, preferably of the BIB type, and substantially comprises a main body 3 (FIG. 8) comprising a connecting element 3.20 comprising fitting means 3.1 with the container, for example composed of an elongated end 3.1, having preferably a cylindrical shape, placed preferably perpendicular with respect to a front supporting body 3.21 (FIG. 8), also having preferably a cylindrical shape, which contains the geometries necessary to obtain liquid sealing means 3.4 and fitting/removal-preventing/counterfeit-preventing means 3.5 with the container, preferably of the BIB type.

Figure 2:
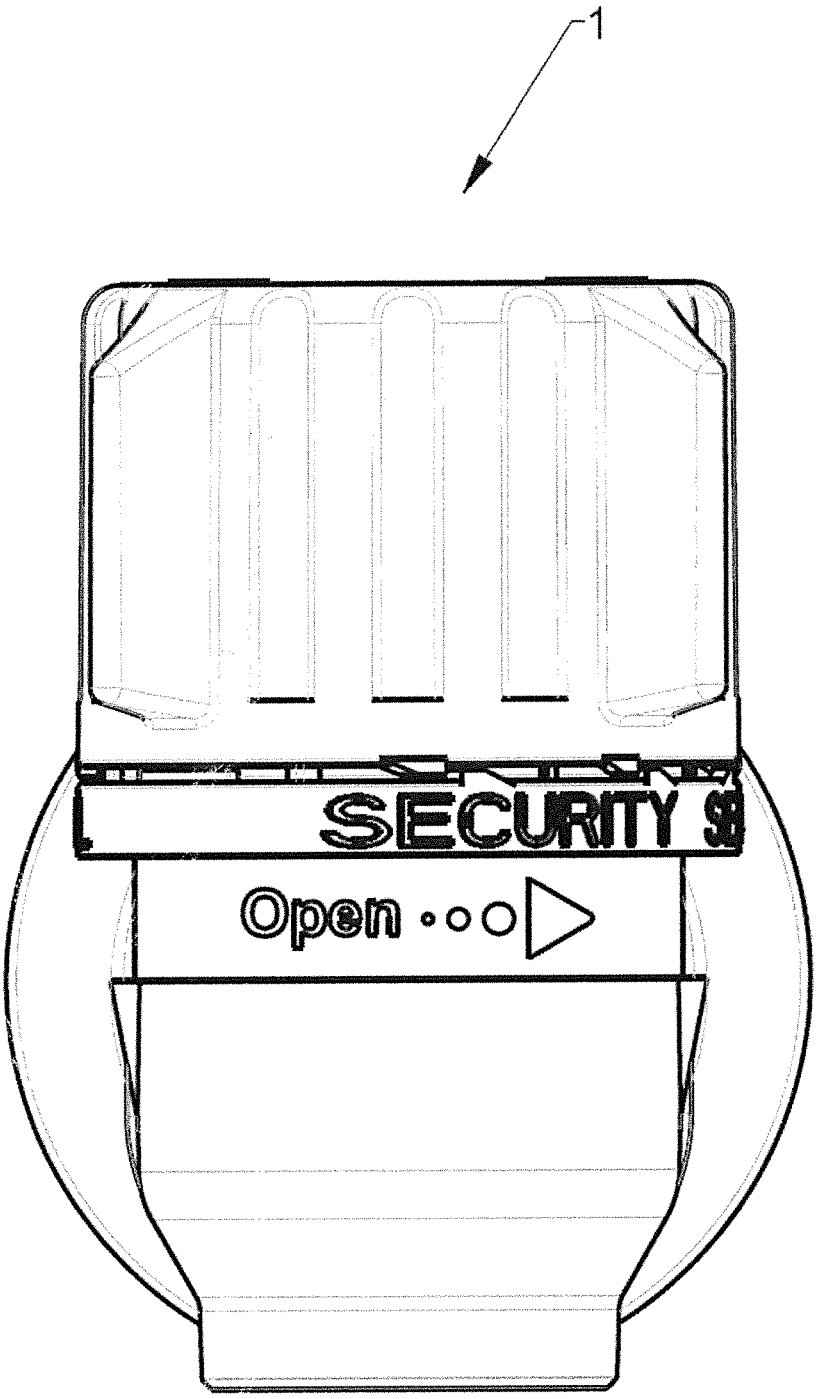
FIG. 2 is a front view of an embodiment of the tap according to the present invention.
Figure 3:
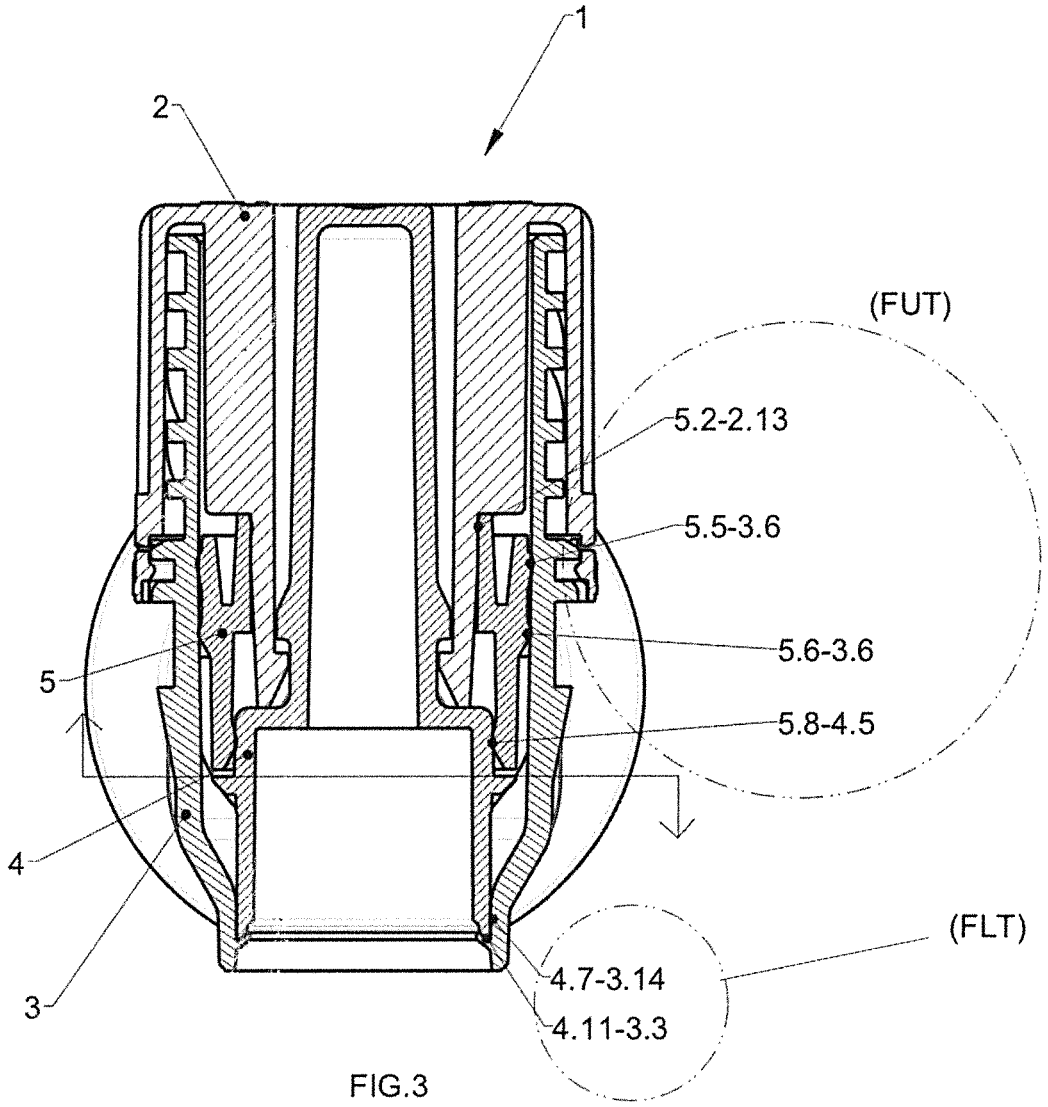
FIG. 3 is a front sectional view of an embodiment of the assembled tap according to the present invention.
Figure 4:
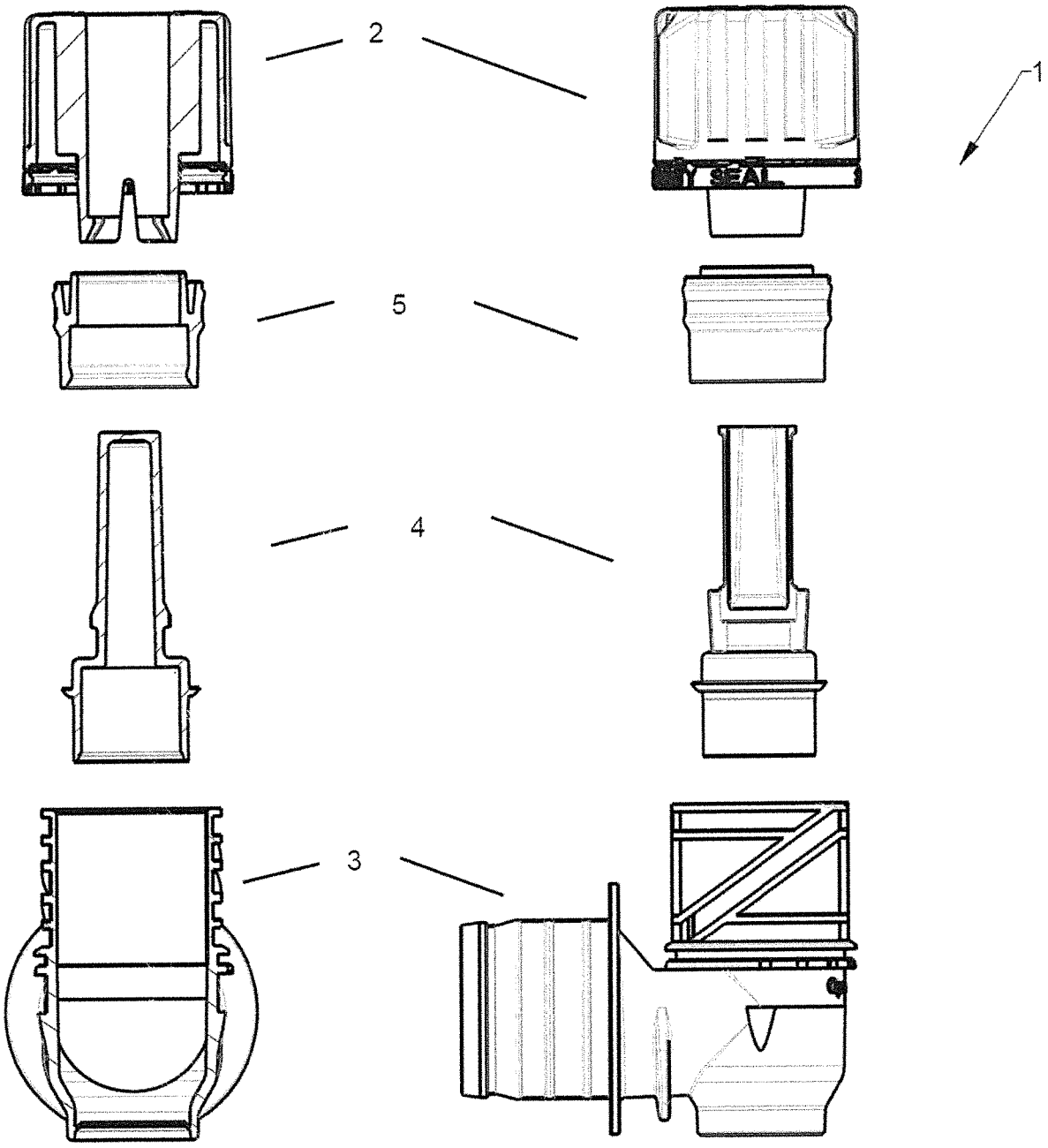
FIG. 4 is a front view and an exploded sectional side view of an embodiment of the tap according to the present invention.
Figure 5:
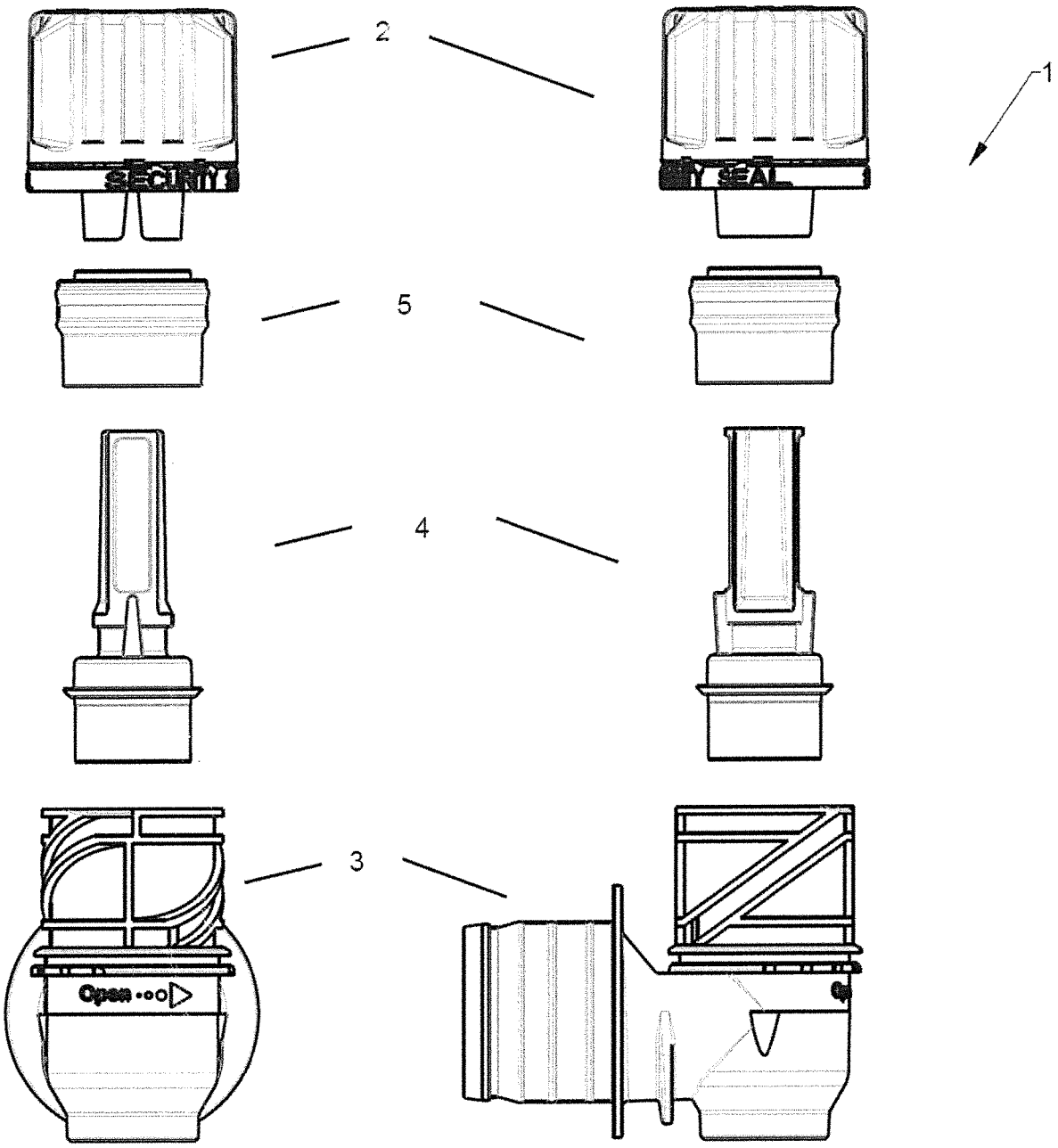
FIG. 5 is a front view and an exploded side view of an embodiment of the tap according to the present invention.

Preferably placed perpendicular with respect to the elongated cylinder 3.20, instead, there is the cylinder 3.21, which is equipped with at least one outlet opening 3.2 for exiting liquid, and is equipped with body sealing means 3.3, preferably composed of a flexible lip, adapted to be operatively coupled with lower sealing means 4.11 of the stem 4 (shown in FIG. 10), and comprises an internal surface 3.14 with cylindrical geometry adapted to be coupled with sealing with an external profile shaped as an "overturned cone" 4.7 of the stem 4 (FIG. 10), generating the seal to liquids on the outlet hole of the tap 1, when it is in its closing position, as shown in FIG. 3. Internally, the main body 3 of FIG. 8, at its opposite end, comprises an internal surface 3.6, preferably cylindrical, which is the abutment and sliding seat, which makes it possible to obtain a static seal, once having reached the opening step of the plug 11 (FIGS. 6 and 7) and once having reached the closing step of the plug 11 (FIGS. 2, 3 and 18) of the tap 1, and a dynamic seal (when moving the plug 11 assembly) to get to the opening step (FIGS. 6 and 7) and the closing step (FIGS. 2, and 18) of the tap 1, due to the operating coupling of geometries designed ad hoc, which will be better described below.

Figure 8:
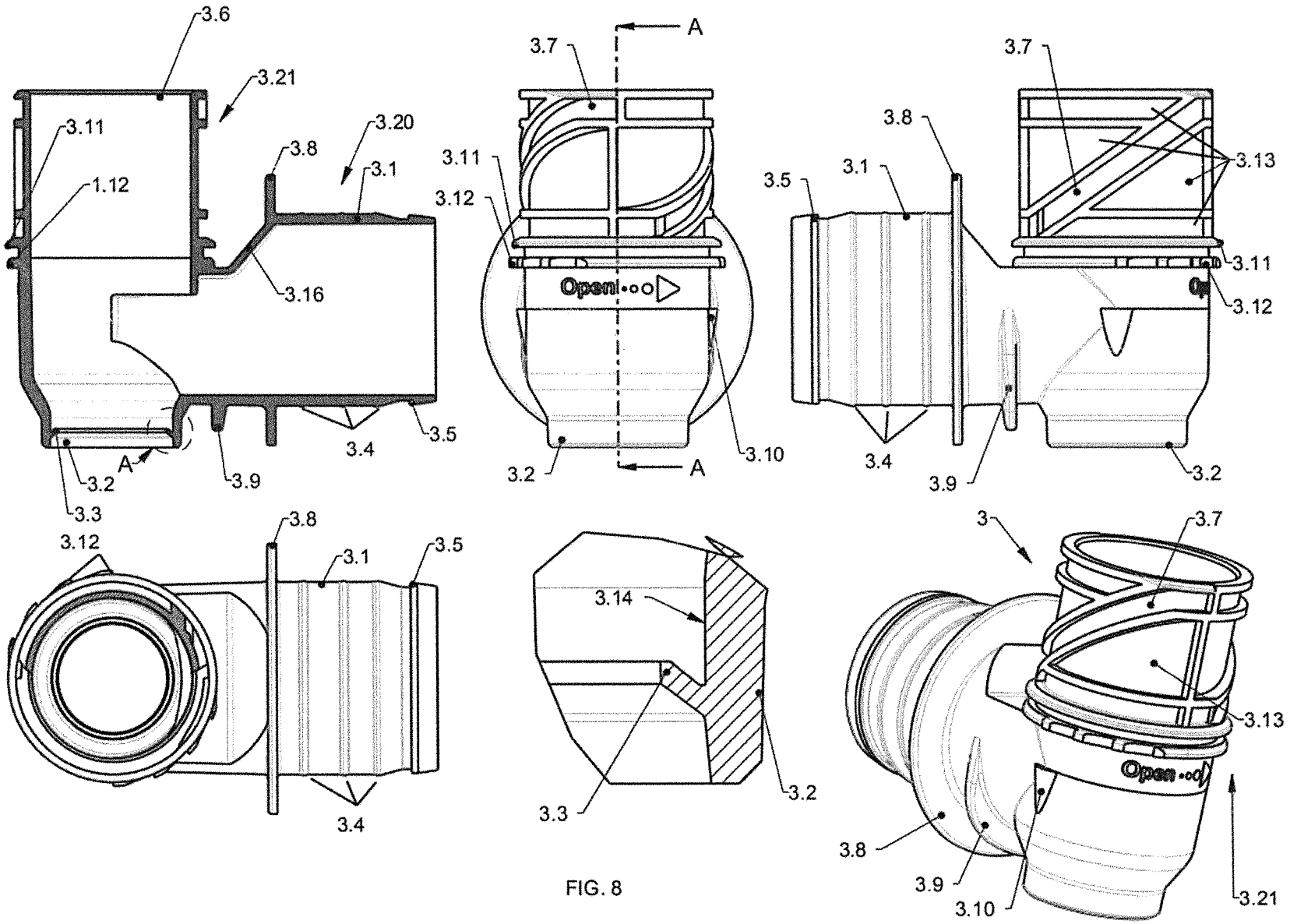
FIG. 8 is a front, sectional side, upper and isometric view of a component of the tap according to the present invention.
Figure 12:
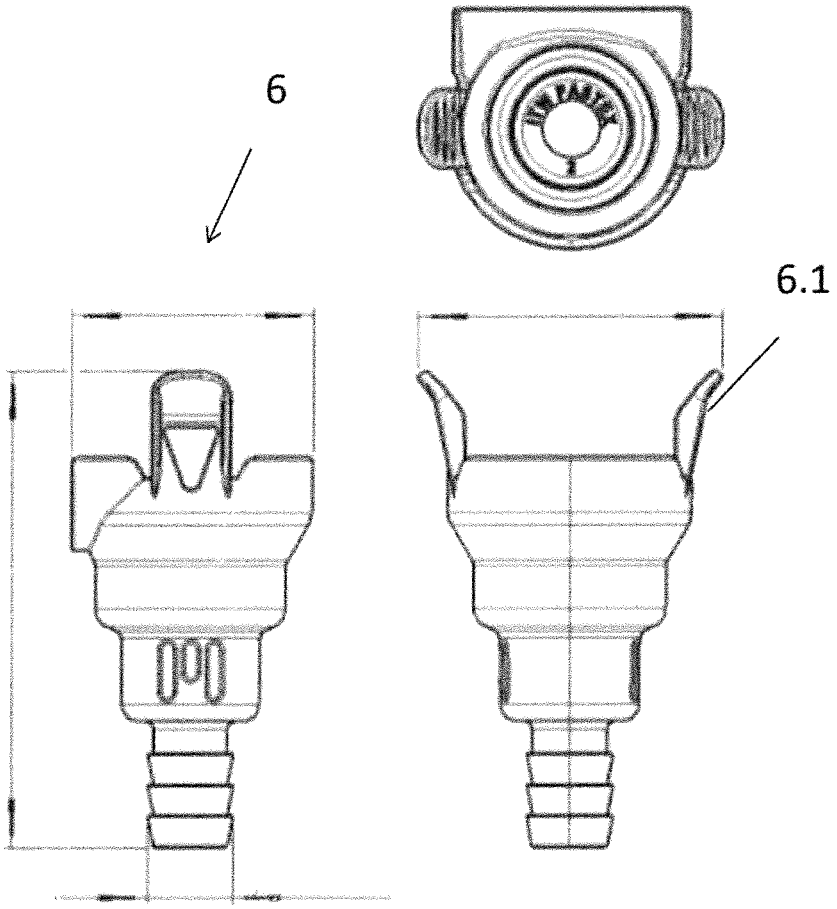
PRIOR ART FIG. 12
FIG. 12 is a front, side and bottom view of a first connector for containers according to the prior art.
Figure 13:
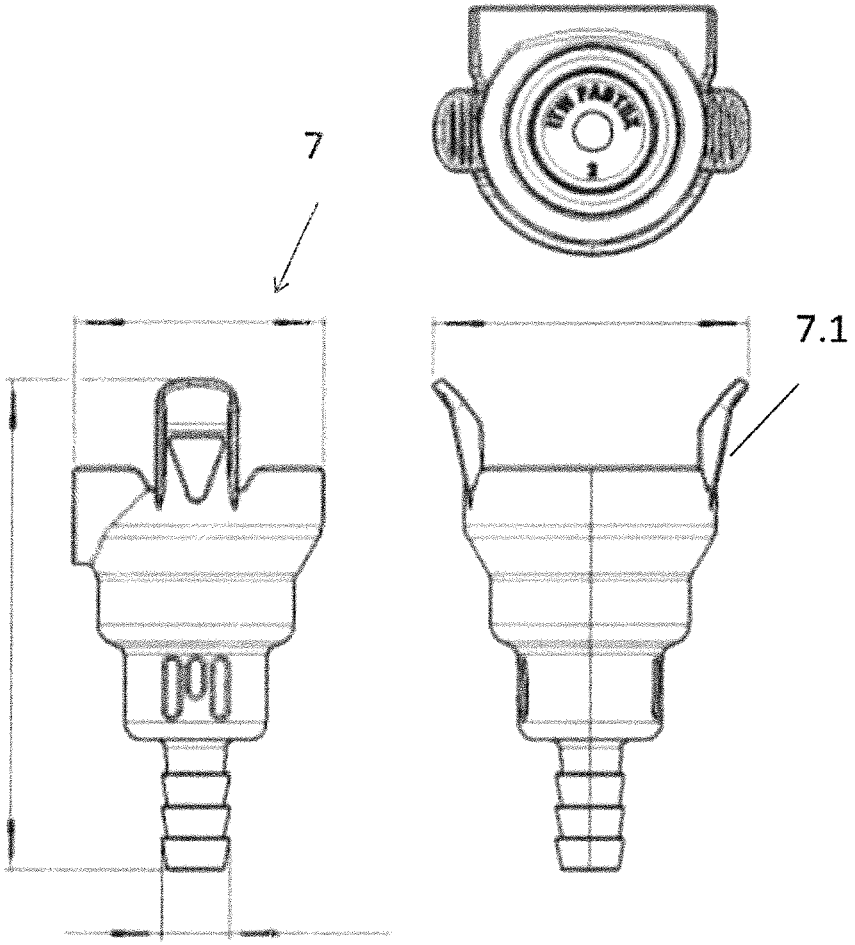
PRIOR ART FIG. 13
FIG. 13 is a front, side and bottom view of a second connector for containers according to the prior art.
Figure 14:
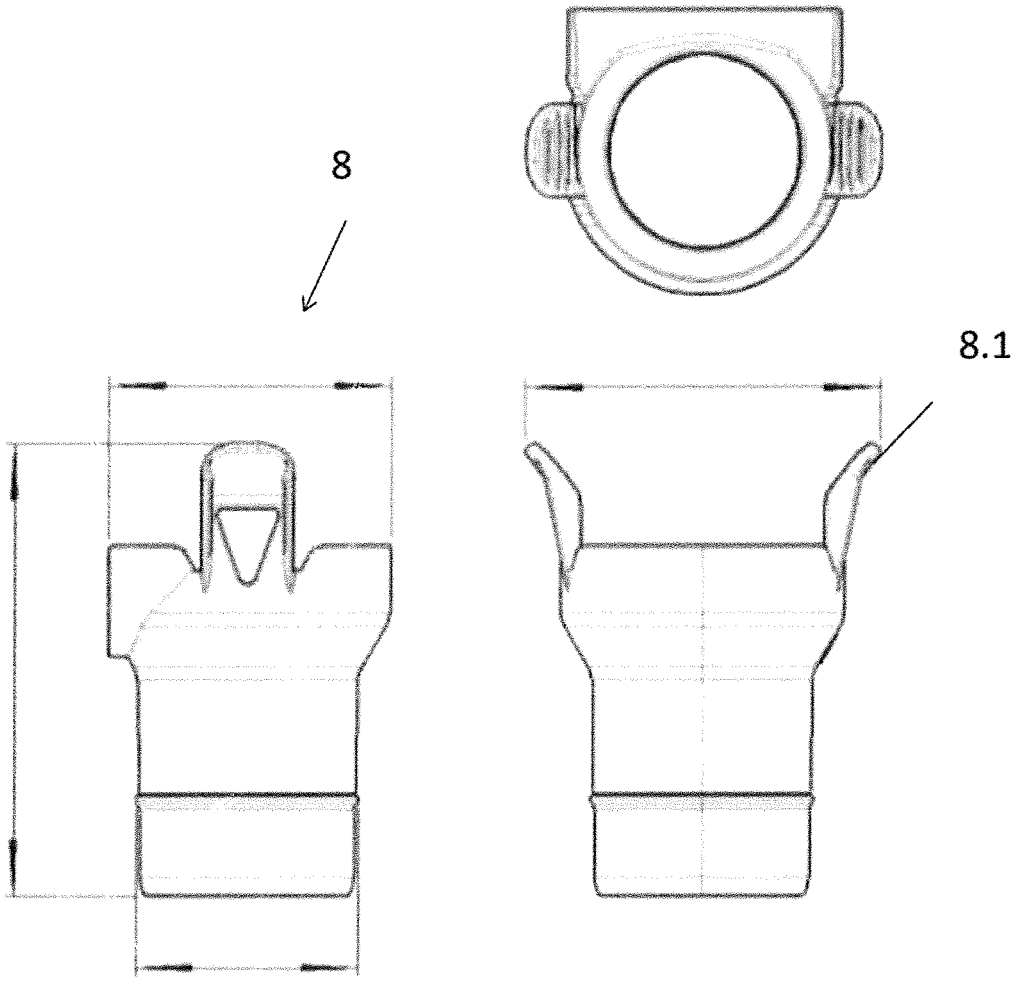
PRIOR ART FIG. 14
FIG. 14 is a front, side and bottom view of a third connector for containers according to the prior art.
Figure 15:
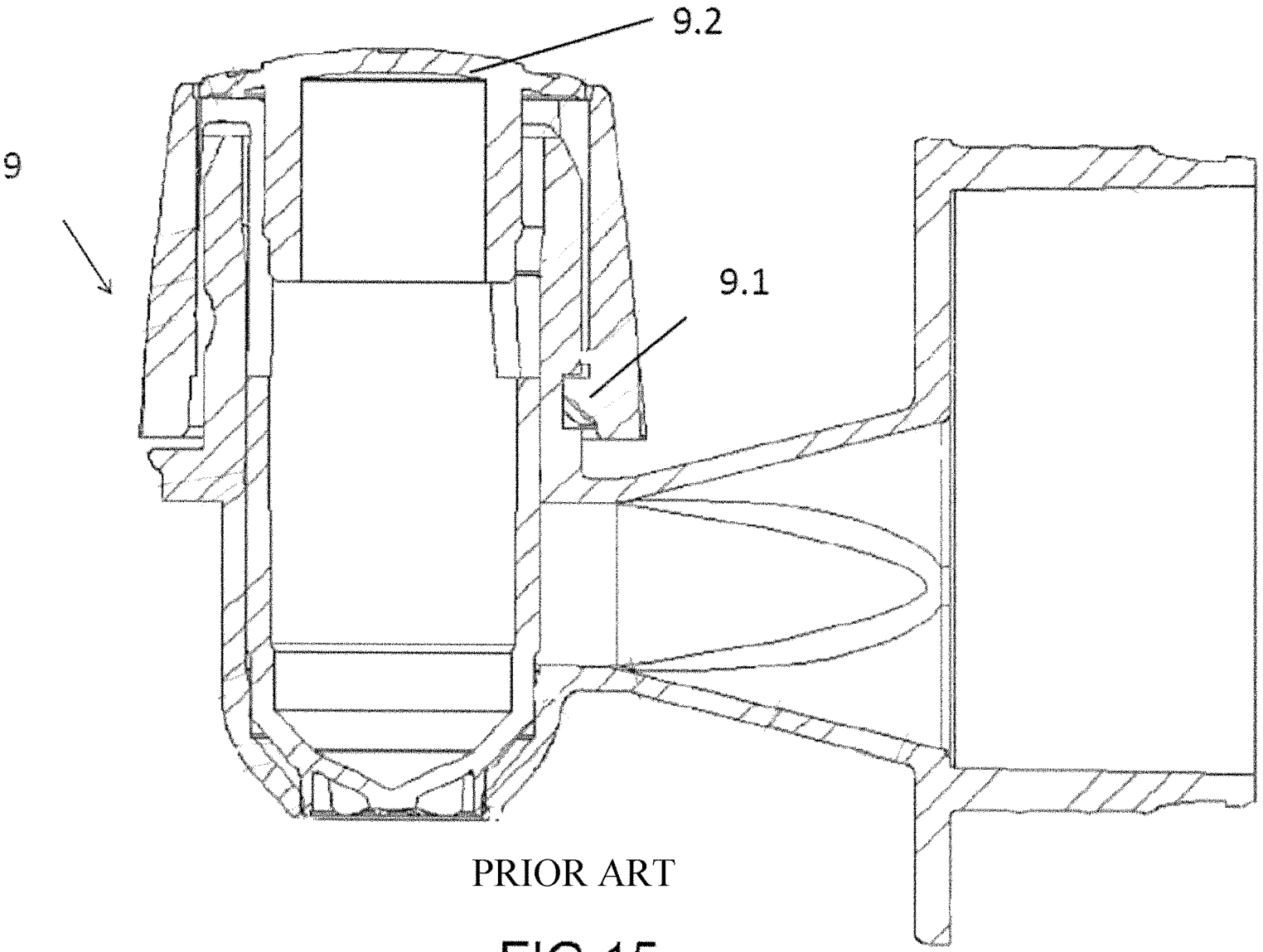
PRIOR ART FIG.15
FIG. 15 is a sectional view of a first tap according to the prior art.
Figure 16:
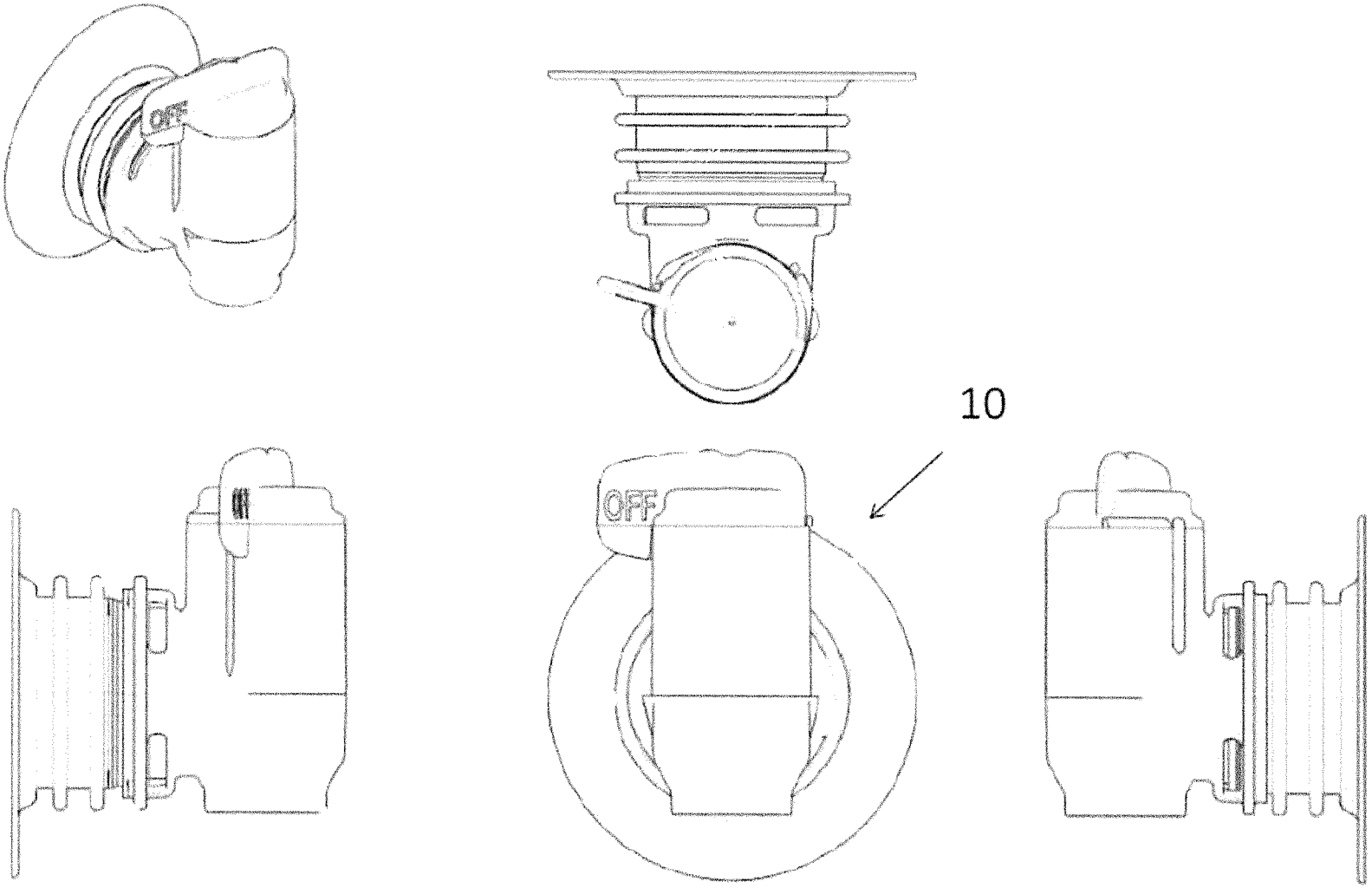
FIG.16 PRIOR ART
FIG. 16 is an isometric, top, right side, front and left side view of a second tap according to the prior art.

Externally, the supporting body 3 of FIG. 8 has fastening elements 3.10 adapted to block and stabilize, with an abutment 3.9, the existing connectors shown in FIGS. 12, 13 and 14, and nowadays present on the market, allowing the inventive tap to be suited to existing solutions without any problem.

Externally, there are rotation abutting elements 3.12 and fastening elements 3.11 to allow the first division of the tamper evident seal 2B which is on the particular upper plug 2, as described below more in detail.

The supporting body 3 further comprises external guiding means 3.7, which operate as guides, preferably with a cam profile, and which transform the rotation motion imposed when opening and closing by the end user, into a linear motion due to the cooperation between internal guiding means 2.2 to the upper plug 2 and external guiding means 3.7, preferably raceways, created outside the front supporting body of FIG. 8.

To point out the "eco-friendly" character oif the application, material which is not necessary will be removed, by digging weight-reducing recesses 3.13 (FIG. 18) and removing material which is deemed superfluous from the piece of plastic, till a constant thickness is obtained on the whole area where the raceways 3.7 of the cam profile made on the supporting body 3 have been obtained, actually decreasing the amount of material used for producing the supporting body 3 of FIG. 8. In order to connect the two cylinders 3.20 and 3.21 of FIG. 8, a channel is made, shaped with a special chute 3.16, whose purpose is increasing the prevalence of fluid towards the liquid outlet opening 3.2, actually increasing its flow when it is in its opening position.

The upper plug 2 (FIG. 9) externally comprises four wings 2.1 (FIG. 9) adapted to transmit the rotary movement imposed by the user more comfortably for himself, and light-reducing recesses 2.8 adapted to creare, between a wing and the other, a greater grip and above all adapted to reduce the component weight, to have a lower environmental impact (eco friendly) and more yield in its production (and therefore less costs). Externally, it is connected by frangible elements 2.11, for example connecting jumpers, and by elements 2.10 which enable the transmission of the rotary and descent movement during the first assembling step, so that, at the end of the first assembly, the tamper evident ring will always been one and the same with the rest of the upper plug 2 and breaks down, being divided into two parts 2A and 2B (FIG. 9), pointing out its first opening to the end customer. Such connecting jumpers 2.11 are very important, both when making the upper plug 2, since they allow supplying the plastic material from the upper part 2A to the lower part 2B of FIG. 9, allowing to make a single complete piece, and they also allow the end customer to point out possible tampering, since they break during the first opening of the inventive tap 1 and allow the upper plug 2 to be divided into two parts, the plug 2A and the tamper evident ring 2B.

Figure 6:
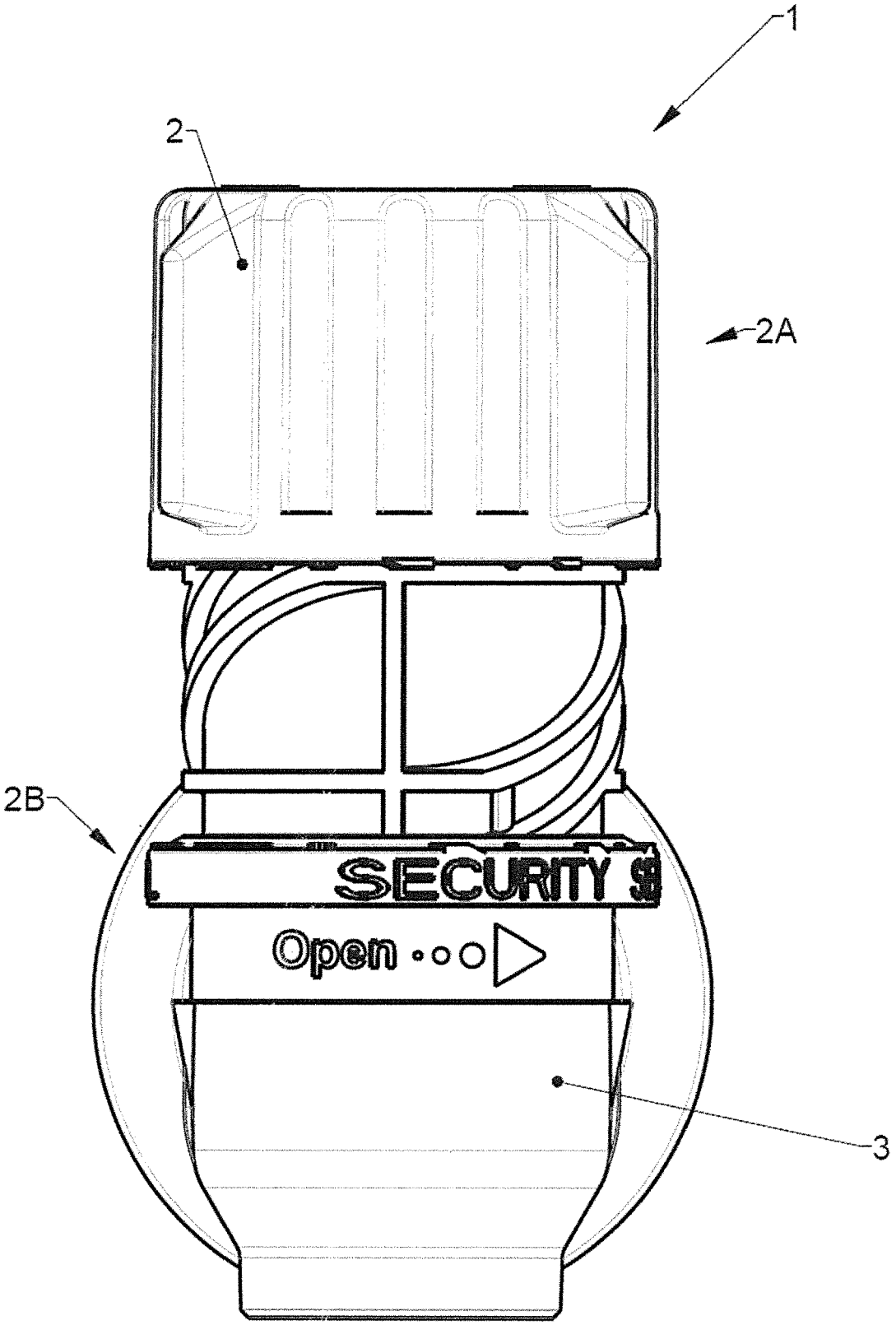
FIG. 6 is a front view of an embodiment of the tap according to the present invention in opening position.
Figure 7:
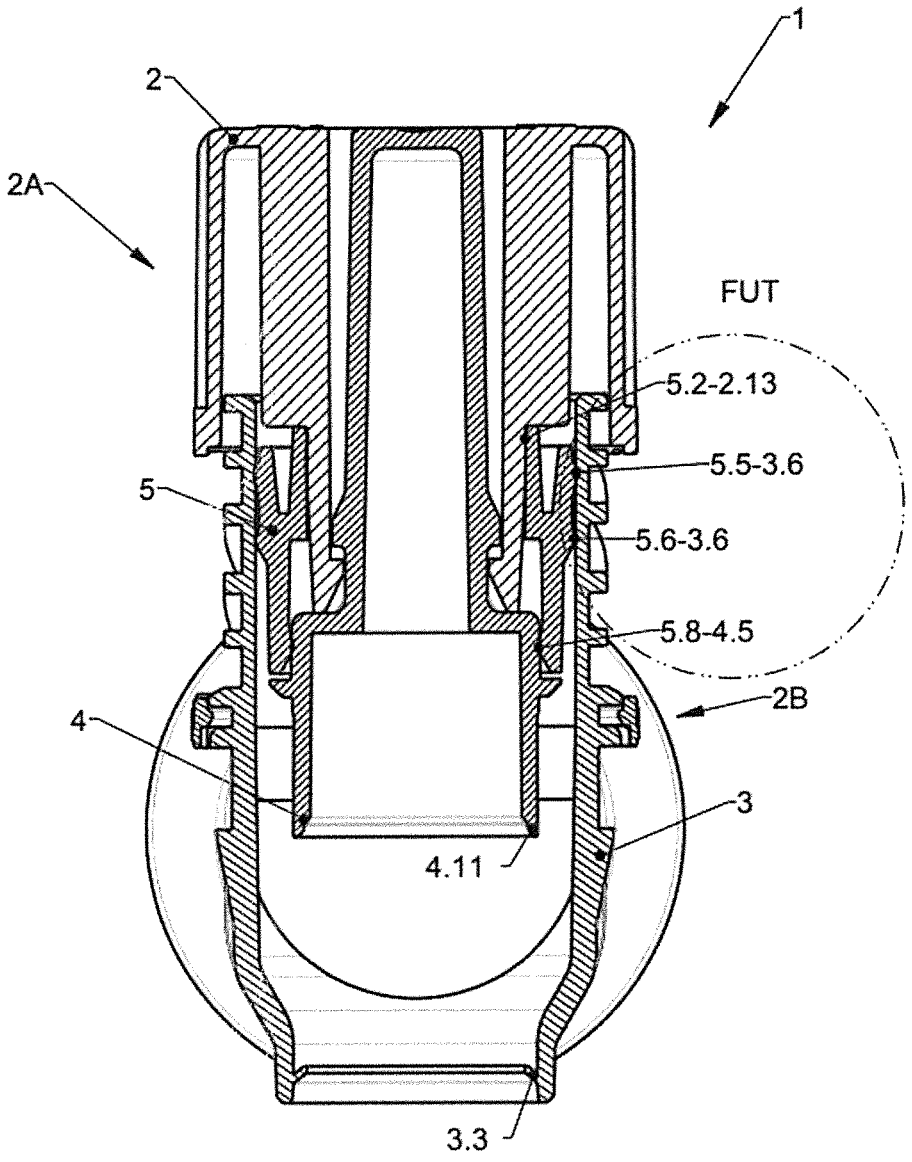
FIG. 7 is a front sectional view of an embodiment of the tap according to the present invention in opening position.
Figure 9:
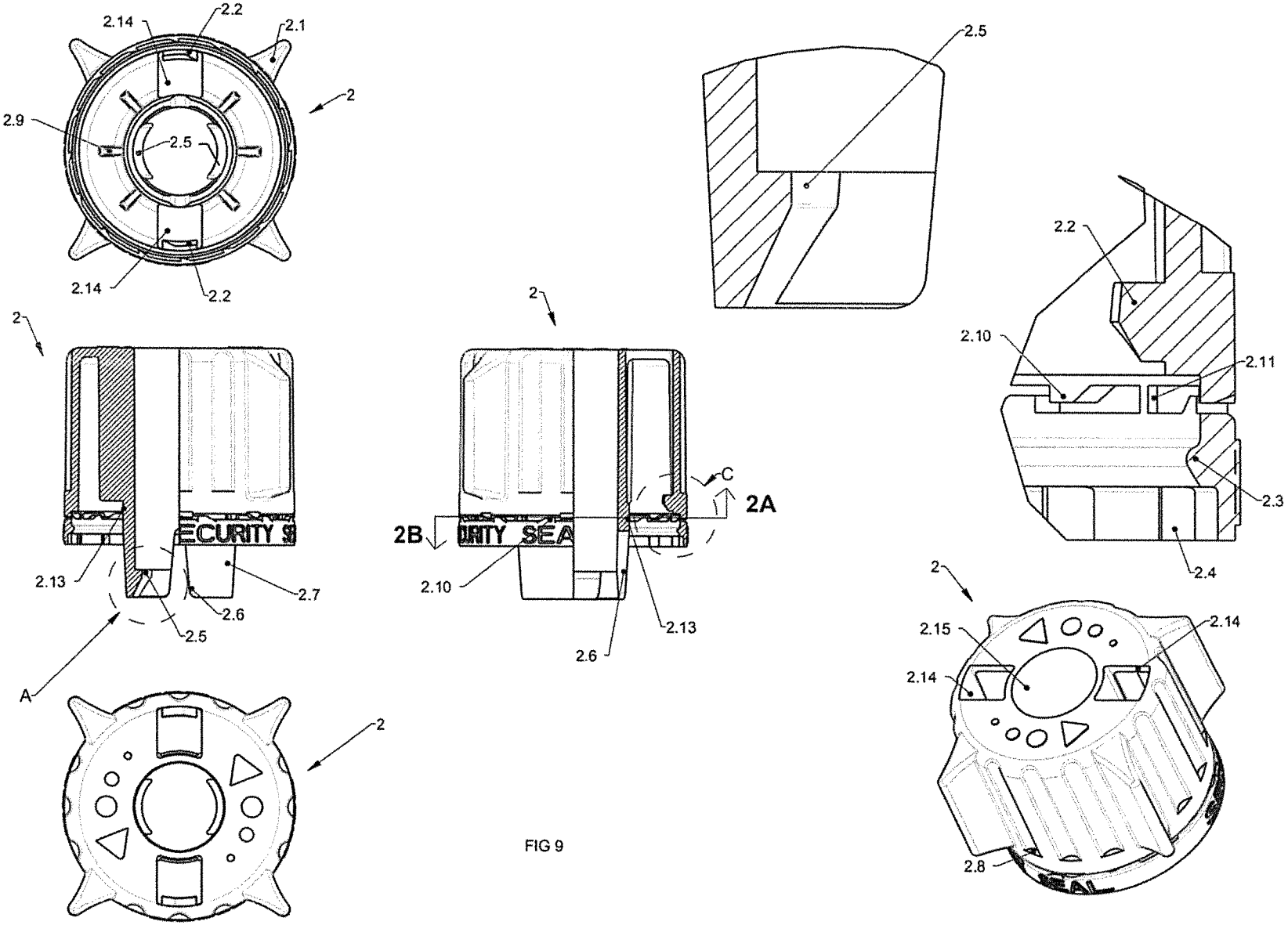
FIG. 9 is a front, side, upper and isometric view of a component of the tap according to the present invention.

Inside the upper plug 2 of FIG. 9, there is a fastening edge 2.3, preferably as an undercut, gets stuck with fastening elements 3.11 of the main body 3 (FIG. 8), enabling to stably constrain the tamper evident ring 2B to the body 3 during the first opening, allowing the division/breakage of the connecting jumpers 2.11 and allowing the division of the two parts 2A and 2B, thereby pointing out the first opening, as shown in FIGS. 6 and 7.

Simultaneously, the rotation-preventing elements 2.4, preferably the small teeth 2.4, of FIG. 9 which are below an undercut slit 2.6, get coupled, once having assembled the tap 1, with the previously-described small rotation-preventing teeth 3.12 present on the main body 3 of FIG. 8 and guarantee, during the first opening, that the tamper evident ring 2B remains unmoving and does not start rotating with the upper part of the upper plug 2 during the first opening, and actually allows also this action in cooperation with the action which will be described below in more detail (undercut slit 2.6 of FIG. 1 on undercut fastening elements 3.11 of FIG. 8), the division/breakage of the warranty seal and therefore the following division of the upper plug into two parts, part 2A to which the other elements, internal valve 5, stem 4 and tamper evident ring 2B are constrained, which remain on the supporting body 3, pointing out the first opening.

Two holes 2.14 are present on the upper plug 2, adapted to allow simply making the internal guiding means 2.2, for example two teeth 2.2, which are coupled with the external guiding means 3.7, for example with the seat of the cam profile 3.7 obtained on the main body 3 (FIG. 8), and allow the guided opening and closing of the upper plug 2 to which the other components (5 and 4) are constrained, as described below.

This arrangement with two upper holes allows making these internal geometries, not having to make complex mechanisms at die level, and therefore strongly saving at investment level for the injection system, which will be simpler and cheaper to make.

The upper plug 2 further comprises a central hole 2.15 which allows, as happened for the small teeth guide 2.2, creating first internal fastening means 2.5, for example two small teeth, which are used to constrain the upper plug 2 to the stem 4 (FIG. 10), as will be described below.

The upper plug 2 comprises upper sealing means 2.13, preferably an internal cylinder 2.13 having a sealing area, which are operatively coupled with first valve sealing means 5.2, for example a flexible lip 5.2 of the internal valve 5.

The internal cylinder 2.13 comprises a weight-reducing slit 2.6 obtained in its lower part, which has two different functions. The first function is allowing to obtain two flexible edges so that the two internal teeth 2.5 can easily by-pass the seat obtained on the stem 4 (FIG. 10) and constrain stably thereto.

The second function is being coupled with a projecting geometry present on the stem 4 which, as described below, allows transmitting the rotary movement, once having completely assembled the plug 1, from the upper plug 2 to the stem 4 (with the sealing valve 5 in between) due to projections 4.1 (FIG. 10) present on the stem, which are located in the slit profile 2.6 made on the lower part of the internal cylinder 2.13.

Finally, a series of ribs 2.9 are internally located, adapted to transmit the descent motion to the upper edge 5.1 of the internal valve 5 (FIG. 11) and allow the correct placement of the internal valve 5.

Figure 10:
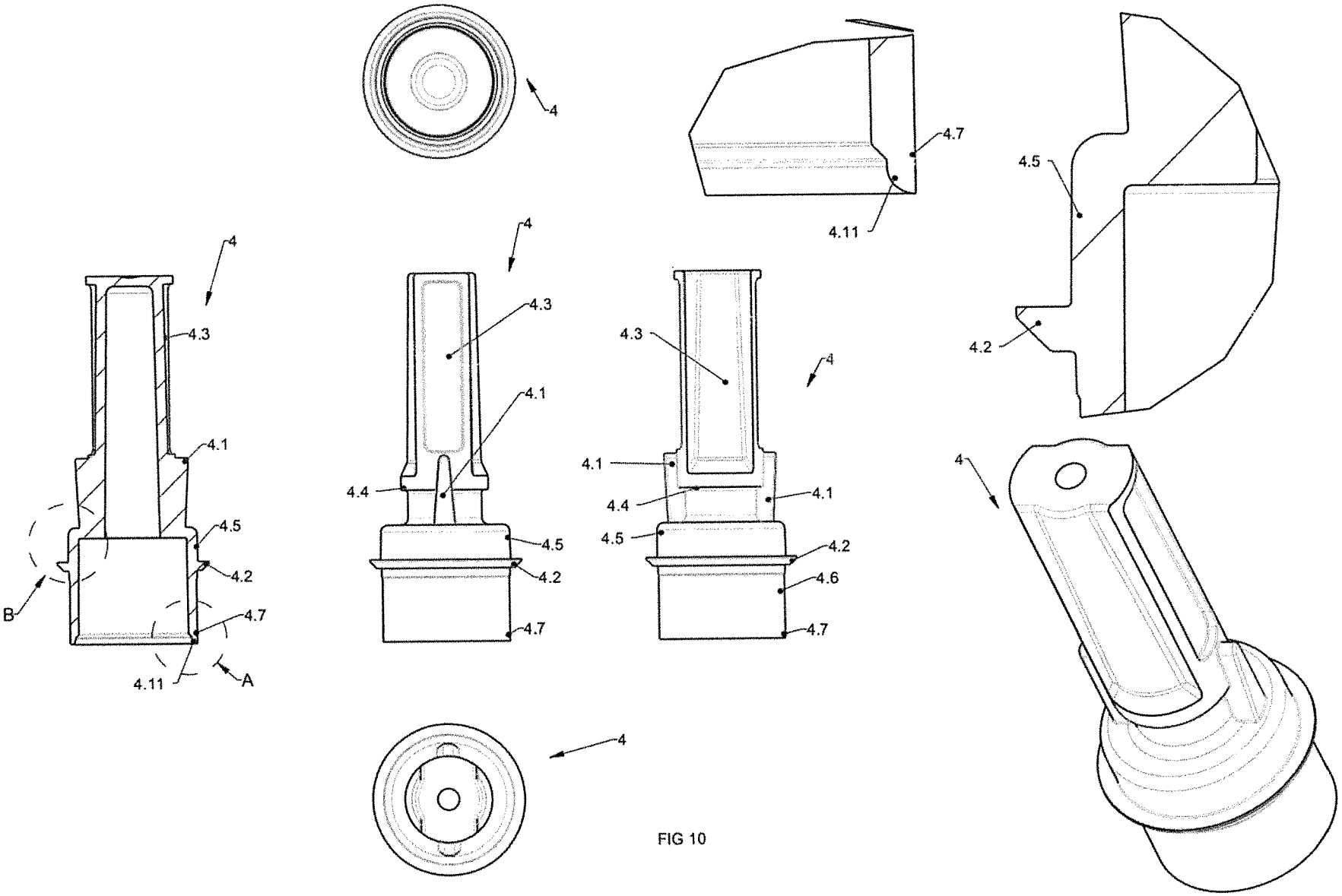
FIG. 10 is a front, sectional side, upper and isometric view of a component of the tap according to the present invention.

The stem 4, with reference to FIG. 10 and starting from the top, comprises recesses to limit the mass of used material and allow producing the component in an eco-friendly manner, pointing out the ecologic aspect and optimizing the production, as occurred for the other components, and obtaining the piece with quicker times during the injection process, optimizing production times and costs for the stem.

The stem 4 comprises second fastening means 4.4, on which the first fastening means 2.5 with flexible teeth of the upper plug 2 (FIG. 9) are stably fastened, and the projections 4.1 for transmitting the rotary movement of the upper plug 2 on the stem 4, which are coupled with the slits 2.6 obtained on the internal cylinder 2.13 of the upper plug 2.

The stem 4 further comprises stem sealing means 4.5, which are coupled with lower valve sealing means 5.8, preferably with flexible lip 5.8, of the valve 5, performing an operating seal.

The stem 4 comprises abutment elements 4.2, which transmit the descent motion of the upper plug 2 when it passes from the opening position to the closing position, due to the coupling with the lower edge 5.3 of the internal valve 5. Finally, there is a lower sealing area, which performs the airtight closure of the plug due to the simultaneous coupling of the lower sealing means 4.11, preferably a sealing lip 4.11, on the flexible lip 3.3 of the main body 3.

Due to the contrary conical profile of the external surface 4.6 of the stem 4, the main seal, in addition to the above mentioned coupling, therefore sealing lip 4.11 on the flexible lip 3.3 of the main body 3, also has a second seal between the contrary cone obtained on the external surface 4.6 of the stem 4 of FIG. 10, and the internal surface 3.14 of the main body 3 of FIG. 8, thereby performing a double seal in the plug closing phase.

The internal valve 5 with flexible edges can be considered the core of the inventive tap 1: in fact, due to this, by means of the multiple coupling areas which make a connected component perform a liquid seal with another, the seal of the inventive tap 1 is performed.

Externally, the internal valve 5 comprises a flexible lip 5.10 (FIG. 11) on which second valve sealing means 5.5 and 5.6 are obtained, comprising two sealing areas 5.5 and 5.6, which perform a dynamic seal when the valve 5, constrained to the upper plug 2 and the stem 4, moves upwards and downwards due to the cam profile 3.7 of the main body 3 (FIG. 8) and the small internal tooth 2.2 of the upper plug 2 of FIG. 9 on the internal surface 3.6 of the main body 3 of FIG. 8, and a static seal when the plug is in its closing and/or opening position.

The lower part of the valve comprises a lower elongated cylinder 5.9 (FIG. 11), on which the lower valve sealing means 5.8 are internally obtained, which are coupled with the stem sealing means 4.5 of the stem 4. The lower edge 5.3 of the internal valve 5 of FIG. 11 transmits the opening/rising motion of the stem 4 to the internal valve 5, using the plane 4.2 of FIG. 10 as abutment, the lower edge 5.3 of the valve 5 transmitting the rising motion to the components connected thereto.

Internally, the internal valve 5 comprises on the upper part another elongated cylinder 5.11, on which the first valve sealing means 5.2 are obtained, which perform the operating seal with the internal cylinder 2.13 of the upper plug 2 of FIG. 9. Finally, the upper edge 5.1 transmits the descent/closing motion from the upper plug 2 due to the internal ribs 2.9 (FIG. 9), transmitting the descent motion to the components connected thereto.

Figure 17:
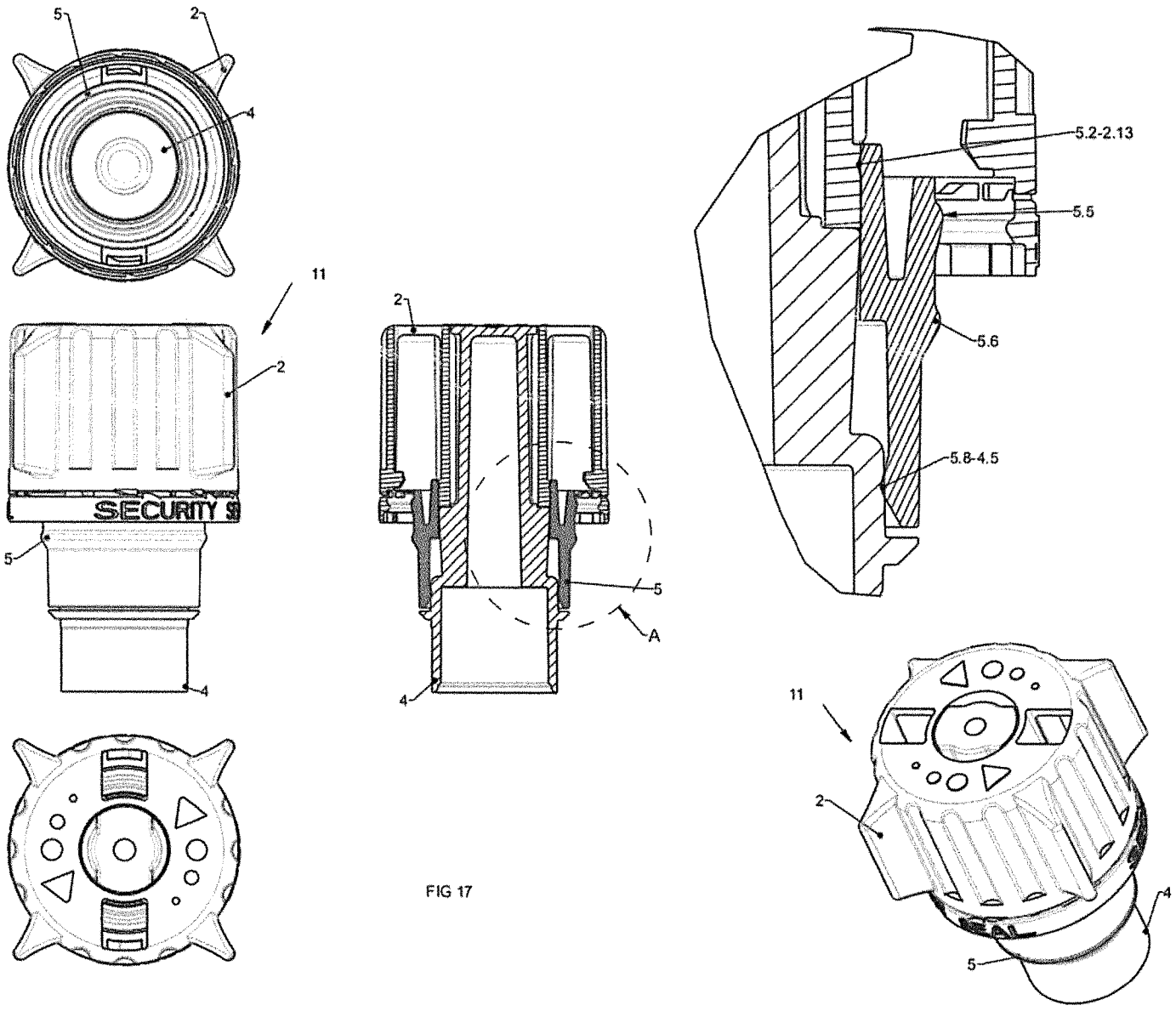
FIG. 17 is an isometric, side sectional and detailed view of an embodiment of the tap according to the present invention.

Taking now into account FIG. 17, the assembly composed of the three above mentioned part, namely upper plug 2, internal valve 5 and stem 4 is described, to understand how they are assembled and which are the multiple seals which allow creating, from three simple parts produced in three different moments and with three different materials, a single part called closing plug (FIG. 17), which is the core of the tap 1 of the invention.

Taking into account the upper plug 2 (FIG. 9), the internal valve 5 (FIG. 11) and the stem 4 (FIG. 10), the description is made first of all about their correct assembling, and which are the geometries that allow creating, from three distinct part, a single component having better features, impossible to obtain in a single piece, with the simple and cheap injection mold.

The internal valve 5 is inserted, oriented, on the upper plug, till the upper edge 5.1 of the valve 5 touches the internal ribs 2.9 of the upper plug 2. This allows the valve to stop at its correct assembling height with respect to the upper plug 2, and further allows the internal sealing lip 5.2 of the valve 5 to be operatively coupled with the internal sealing cylinder 2.13 of the upper plug 2, generating interference and liquid seal.

After this, by orienting the stem so that the projections 4.1 of the stem 4 are aligned with the slits 2.6 present on the upper plug 2, the stem 4 is inserted and fastened on the previously prepared assembly, comprising the internal valve 5 assembled on the upper plug 2, stably constraining them due to the flexible engagement 2.6 obtained on the upper plug 2, which comprises therein the fastening teeth 2.5 (FIG. 9) on the second undercut fastening means 4.4 of the stem 4 of FIG. 10.

Simultaneously, the lower cylinder 5.9 of the internal valve 5 on which the lower valve sealing means 5.8 are obtained, is stably coupled with the stem sealing means 4.5 present on the stem 4 of FIG. 10, generating another operating seal.

Figure 11:
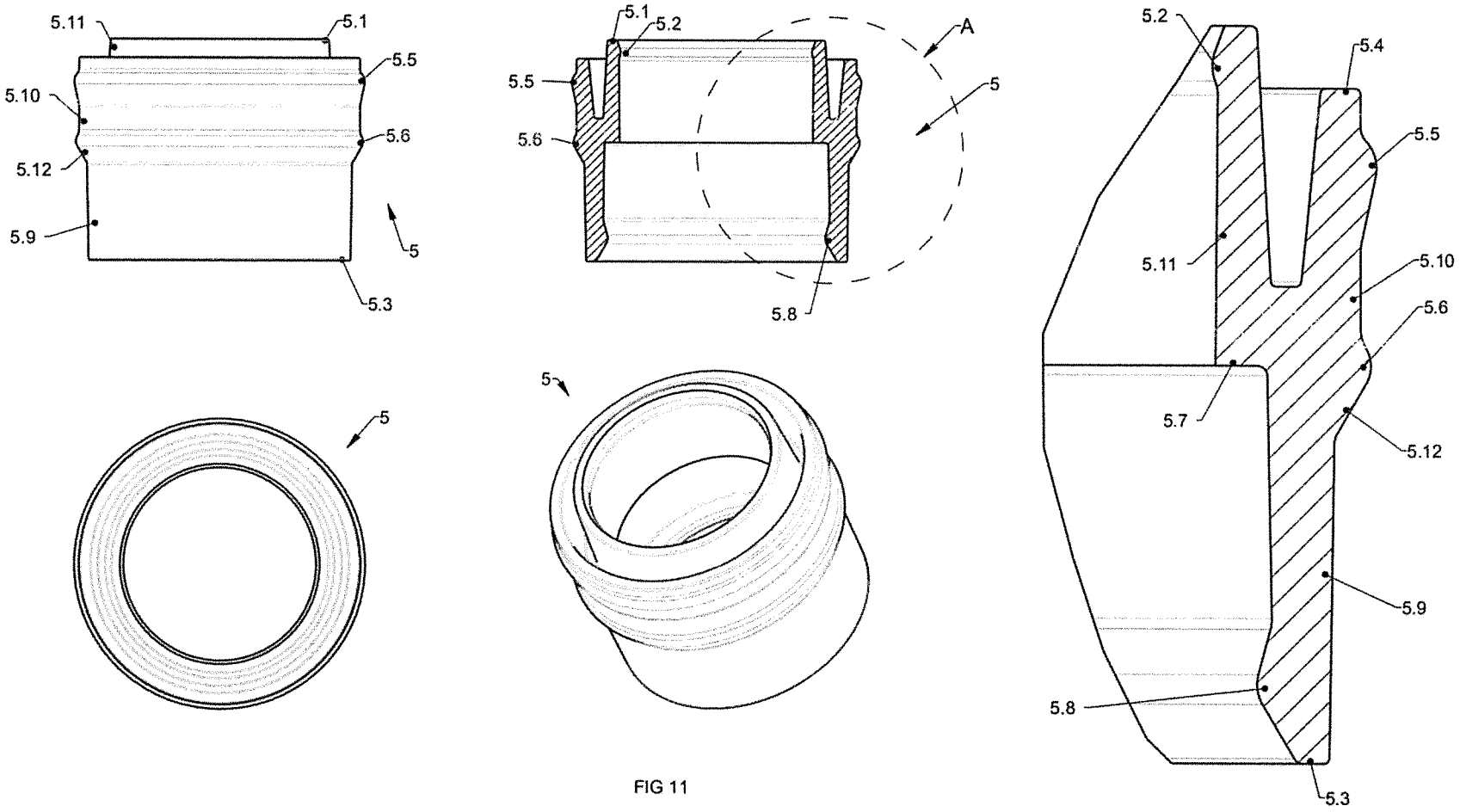
FIG. 11 is a front, sectional side, upper and isometric view of a component of the tap according to the present invention.

As shown in FIG. 17, a single piece 11 is thereby obtained, which already has multiple seals among its various elements (5.2-2.13 and 5.8-4.5) and stable fasteners between the upper plug 2 (2.5 of FIG. 9) and stem 4 (4.4 of FIG. 10), which between them contain the internal flexible valve 5 blocked on the upper edge 5.1 of FIG. 11 by an abutment given by the ribs 2.9 of FIG. 9, and on the lower part by the abutment between the lower edge 5.3 of the internal valve 5 and the abutment elements 4.2.

In this way, a single piece, called closing plug 11, has been created from three parts; such closing plug 11 is then inserted into the main body 3 in order to generate the necessary seals for the correct operation described below.

Figure 18:
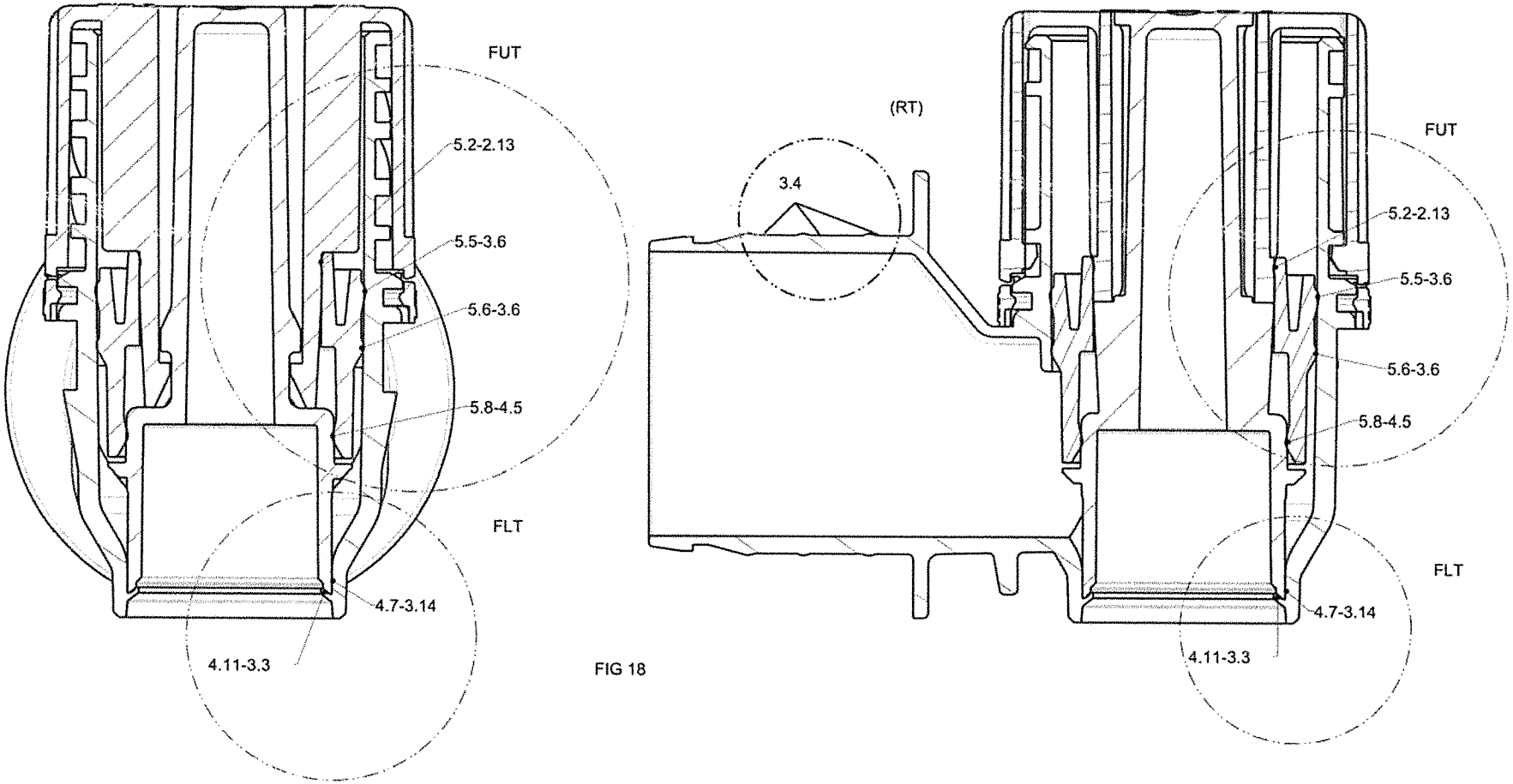
FIG. 18 is an isometric, side sectional and detailed view of an embodiment of the tap according to the present invention in its opening position.

With reference to FIG. 3 and FIG. 18, the inventive tap 1 is shown in section in its closing position at the end of its assembly.

With reference to FIG. 3, there are two types of seal: the prima is called upper front upper seal (FUT) and comprises the seals between the components forming the upper plug 2 (therefore, 5.2-2.13 and 5.8-4.5) and the seals generated between external sealing lip of the flexible valve and the internal sealing cylinder of the main body 3 (namely, 5.5-3.6 and 5.6-3.6).

This FUT system allows having both the static seal of the plug when it is in its closing position (FIG. 18), and in its opening position (FIG. 7) and the dynamic seal, namely when the closing plug 11 moves from the closing position to the opening position, or vice versa. When the inventive tap 1 is in its closing position, also the lower front seal (FLT) can be pointed out, generated by the coupling between stem 4 and main body 3 (4.11-3.3 and 4.6-3.14).

The invention claimed is:

1. A delivering tap for delivering liquid from a container comprising:

a main body comprising:

a connecting element comprising fitting means with the container, and a supporting body adapted to be closed by a plug including an upper plug, the supporting body including:

an outlet opening for exiting the liquid, and body sealing means associated with the outlet opening and adapted to be operatively coupled with lower sealing means of a stem, an internal sealing surface obtained therein, designed to serve as guide and sealing area of an internal valve, and external guiding means, obtained on an external surface of the supporting body and useful to guide the plug in opening and closing steps of the plug, cooperating with internal guiding means present inside the upper plug, to generate a linear movement of the plug when the plug is rotated;

wherein:

the upper plug includes:

the internal guiding means configured to be coupled with the external guiding means of the supporting body, first fastening means, configured to constrain the upper plug to the stem, and upper sealing means configured to be operatively coupled with first valve sealing means of the internal valve;

the stem includes, on an external surface of the stem:

stem sealing means configured to be operatively coupled with lower valve sealing means of the internal valve, the lower valve sealing means being configured to be coupled with the body sealing means of the main body and determine a lower airtight seal of the plug when the tap is not in an operating step; and an internal sealing valve associated with the upper plug;

the stem of the plug includes, on the external surface of the stem:

second valve sealing means with an internal surface of the main body to determine an operating seal of the plug, when following rotation of the plug, an advancement movement of the plug is obtained, the first valve sealing means and the lower valve sealing means being configured to be operatively coupled respectively with the upper sealing means of the upper plug and with the stem sealing means of the stem of the plug, and second fastening means cooperating with the first fastening means of the upper plug; and the plug further includes an internal sealing valve and the stem.

2. The delivering tap of claim 1, wherein the lower airtight seal of the plug when the tap is not in the operating step is determined by the coupling of the external surface of the stem with the internal surface of the supporting body.

3. The delivering tap of claim 1, wherein the upper plug comprises a tamper evident ring connected to an upper part of the upper plug through frangible elements configured to be broken upon a first opening of the tap so that the upper plug is divided into an upper part and a tamper evident ring which will remain constrained to the main body, held by fastening elements of the main body.

4. The delivering tap of claim 3, wherein the main body comprises rotation abutting elements, obtained on the external surface of the supporting body, configured to be coupled with rotation-preventing elements of the upper plug guaranteeing a locking of the tamper evident ring of the upper plug, preventing the tamper evident ring from rotating with the upper part upon the first opening of the tap, thereby allowing separation of the tamper evident ring from the upper part.

5. The delivering tap of claim 1, wherein the upper plug comprises an internal cylinder comprising at least one slit, configured to obtain from the internal cylinder flexible edges on which the first fastening means are obtained, configured to by-pass, when assembling the plug, the second fastening means obtained on the stem, and useful to be stably fastened to the stem, allowing transmission of rotary movement from the upper plug to the stem of the plug during the opening/closing step.

6. The delivering tap of claim 5, wherein the stem comprises two projections configured to be coupled with the slits of the internal cylinder of the upper plug, the projections being useful to transmit the rotary movement of the upper plug to the stem once assembled.

7. The delivering tap of claim 1, wherein the first valve sealing means and the lower valve sealing means of the internal valve are flexible edges.

8. The delivering tap of claim 1, wherein the connecting element of the main body comprises a removal-preventing system which operates as removal-preventing and counterfeit-preventing abutment of the tap once inserted into a connecting mouth.

9. The delivering tap of claim 1, wherein the external guiding means have a cam profile.

10. The delivering tap of claim 1, wherein the connecting element comprises a chute-type surface configured to give a prevalence to the liquid which allows increasing flow towards the outlet opening when the plug is in an opening position.

* * * * *